US007057346B2

(12) United States Patent
Tukamoto et al.

(10) Patent No.: US 7,057,346 B2
(45) Date of Patent: Jun. 6, 2006

(54) SHORT ARC ULTRA-HIGH PRESSURE MERCURY LAMP AND METHOD FOR THE PRODUCTION THEREOF

(75) Inventors: Takuya Tukamoto, Himeji (JP); Yoshihiro Horikawa, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 226 days.

(21) Appl. No.: 10/775,205

(22) Filed: Feb. 11, 2004

(65) Prior Publication Data

US 2004/0155588 A1 Aug. 12, 2004

(30) Foreign Application Priority Data

Feb. 12, 2003 (JP) ..... 2003-033811

(51) Int. Cl.
*H01J 17/04* (2006.01)

(52) U.S. Cl. ..... 313/631; 313/637; 313/640

(58) Field of Classification Search ..... 313/567, 313/568, 571, 574, 576, 620, 631, 637–643
See application file for complete search history.

(56) References Cited

U.S. PATENT DOCUMENTS

| | | | |
|---|---|---|---|
| 5,109,181 | A | 4/1992 | Fischer et al. |
| 5,497,049 | A | 3/1996 | Fischer |
| 6,545,430 | B1 | 4/2003 | Ono et al. |

FOREIGN PATENT DOCUMENTS

| | | |
|---|---|---|
| JP | 2001-059900 | 3/2001 |
| JP | 2001-174596 | 6/2001 |

*Primary Examiner*—Vip Patel
(74) *Attorney, Agent, or Firm*—David S. Safran

(57) ABSTRACT

An ultra-high pressure mercury lamp is provided in which the disadvantage caused by projections formed on the electrode tips during operation can be eliminated. This is achieved by an arrangement in which a silica glass arc tube, filled with at least 0.15 mg/mm$^3$ of mercury, rare gas and halogen in the range from $10^{-6}$ μmole/mm$^3$ to $10^{-2}$ μmole/mm$^3$, includes a pair of opposed electrodes spaced a distance of at most 2 mm. Additionally, at least one of the electrodes includes a part with a greater diameter which is formed on the electrode shaft using a melting process, a projection which is formed by the tip of the electrode shaft, and a part with a decreasing diameter which extends from the part with the greater diameter in the direction toward the projection.

23 Claims, 7 Drawing Sheets

Fig. 2(a)
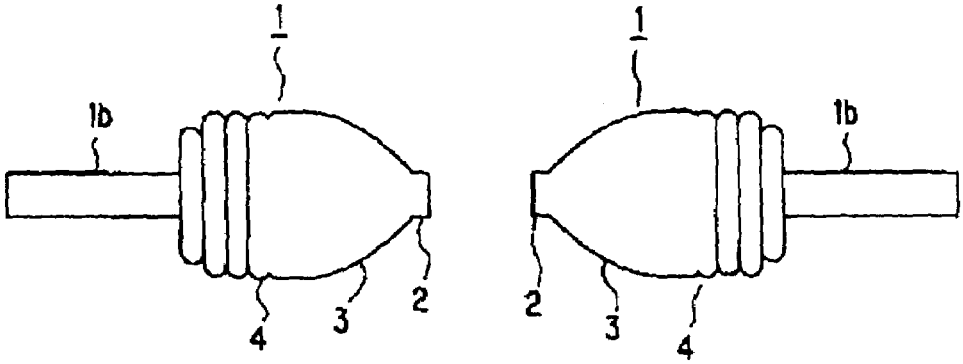
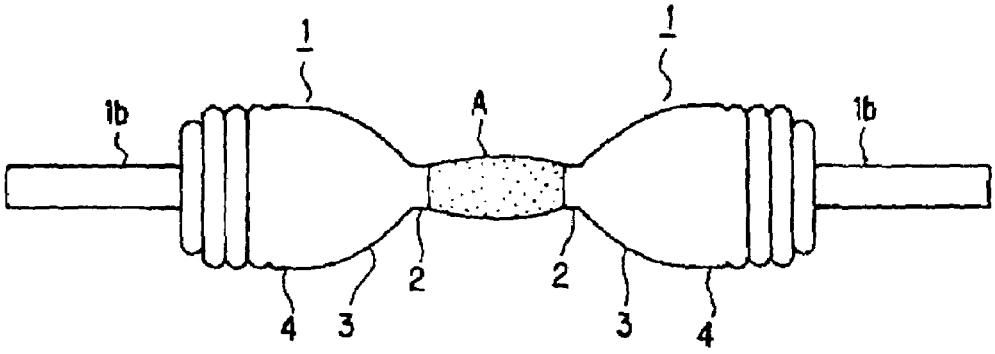
Fig. 2(b)

Fig. 7(a) (Prior Art)
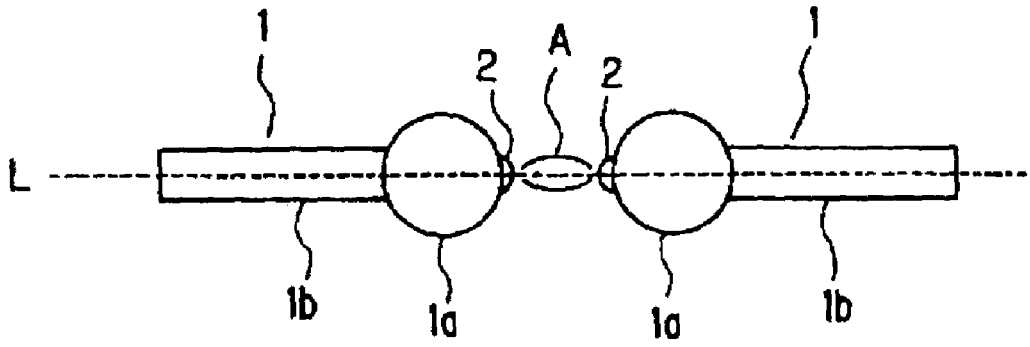
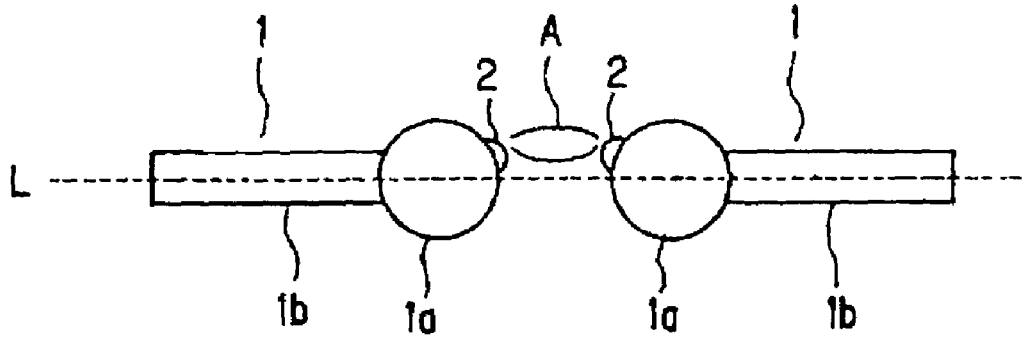
Fig. 7(b) (Prior Art)

SHORT ARC ULTRA-HIGH PRESSURE MERCURY LAMP AND METHOD FOR THE PRODUCTION THEREOF

BACKGROUND OF THE INVENTION

1. Field of the Invention

The invention relates to a short arc ultra-high pressure mercury lamp. The invention relates especially to a discharge lamp used as a light source for a liquid crystal display device in which the light source is an ultra-high pressure mercury lamp filled with at least 0.15 mg/mm$^3$ of mercury, and in which the mercury vapor pressure during operation is greater than or equal to 110 atm. The discharge lamp can also be used in a projector device such as a digital light processor (DLP) or the like having a digital micro mirror device (DMD).

2. Description of the Related Art

In a projector device of the projection type, there is a demand for illumination onto an image device in a uniform manner and with adequate color rendering. The light source is therefore often a metal halide lamp which is filled with mercury and a metal halide. Furthermore, recently smaller and smaller metal halide lamps and point light sources are being produced for such use and these lamps have extremely small distances between the electrodes.

Instead of metal halide lamps, discharge lamps with an extremely high mercury vapor pressure, for example with 150 atm, have been recently proposed. In these lamps, the broadening of the arc is suppressed (the arc is compressed) by the increase of the mercury vapor pressure and a substantial increase of light intensity is realized. Lamps of these ultra-high pressure discharge type are disclosed, for example, in Japanese Patent document HEI 2-148561 (see the English equivalent—U.S. Pat. No. 5,109,181) and Japanese Patent document HEI 6-52830 (see the English equivalent—U.S. Pat. No. 5,497,049).

When an ultra-high pressure mercury lamp is used, a pair of opposed electrodes are positioned with a spacing distance of at most 2 mm in a silica glass arc tube filled with at least 0.15 mg/mm$^3$ of mercury and halogen in the range of $1\times10^{-6}$ μmole/mm$^3$ to $1\times10^{-2}$ μmole/mm$^3$. The main purpose of adding the halogen is to prevent devitrification of the arc tube. However, when constructed in this manner a so-called "halogen cycle" arises.

In the above described ultra-high pressure mercury lamp (hereinafter also called only a "discharge lamp"), the phenomenon occurs that, in the course of operation, projections are produced on the electrode tips. This phenomenon is not entirely clear, but the following can be reliably determined.

The tungsten which is vaporized from the high temperature area in the vicinity of the electrode tip during lamp operation combines with the halogen and residual oxygen which are present in the arc tube. When bromine (Br) is added as the halogen, it is present in the form of a tungsten compound such as WBr, $WBr_2$, WO, $WO_2$, $WO_2Br$, $WO_2Br_2$ or the like. These compounds decompose in the gaseous phase in the high temperature area in the vicinity of the electrode tip and yield tungsten atoms or cations. Due to thermal diffusion (i.e., diffusion of the tungsten atoms which are moving from the high temperature area in the gaseous phase (=arc center) in the direction of the low temperature area (=vicinity of the electrode tip)) and due to the fact that in the arc the tungsten atoms are ionized, i.e., as cations, the tungsten cations are pulled during operation of the electrode as a cathode by the electrical field in the direction to the cathode. The tungsten vapor density in the gaseous phase in the vicinity of the electrode tip therefore becomes high, which results in precipitation on the electrode tip to form the tungsten projections. The formation of the above described projections is disclosed, for example, in Japanese Patent document 2001-312997 (see the English equivalent—U.S. Pat. No. 6,545,430).

FIGS. 7(*a*) and 7(*b*) each schematically show the electrode tips and projections. In the FIGS. 7(*a*) and 7(*b*), the electrodes 1, as a pair, are formed of a spherical part 1*a* and a shaft 1*b*. On the tip of the spherical part 1*a*, a projection 2 is formed. In the situation in which, at the start of lamp operation, there is no projection, the projections 2 are produced during the subsequent operation, as are shown in the Figures. These projections 2 cause an arc discharge A.

However, the formation and growth of the above described projections have some disadvantages.

Fluctuation of the Lamp Voltage—The above described projections are not present in the lamp when it is manufactured, but the projections are produced and grow in the course of subsequent operation. The formation of projections also depends on the types of lamps and the like, but after for example 80 to 100 minutes have passed, the growth is essentially ended. During formation of these projections and after usage is ceased for the first time, the distance between the electrodes in the course of operation has been shortened. Additionally, the operating voltage of the discharge lamp is reduced.

Reduction of the Light Utilization Efficiency—The above described projections do not always form on the electrode axis. If, for example, as in FIG. 7(*a*) they are formed along the electrode axis L, there is little or no disadvantage. However, there are also situations in which the projections are formed which diverge from the electrode axis, as in FIG. 7(*b*). In this situation, the arc position also deviates from the electrode axis L. The major disadvantage then occurs in that for an optical system designed as a point light source, the degree of light utilization decreases.

SUMMARY OF THE INVENTION

A primary object of the invention is to devise an ultra-high pressure mercury lamp in which the above described disadvantages, caused by projections formed on the electrode tips, can be eliminated.

The above described object is achieved according to a first embodiment of the invention in which a short arc ultra-high pressure mercury lamp, which includes a silica glass arc tube having positioned therein a pair of opposed electrodes spaced apart a distance of less than or equal to 2 mm and filled with greater than or equal to 0.15 mg/mm$^3$ mercury, rare gas and halogen in the range from $1\times10^{-6}$ μmole/mm$^3$ to $1\times10^{-2}$ μmole/mm$^3$, has at least one electrode of the electrode pair which includes a part with a greater diameter formed on the shaft by melting. A projection is formed by using the tip of the electrode shaft, and there is a decreasing diameter part which extends from the part with the greater diameter in the direction to the projection and which is formed by melting.

The discharge lamp of the invention is characterized specifically in that the projections do not form and grow in the course of operation, but that they are formed beforehand during the production step for the electrodes. This arrangement makes it possible to keep the lamp voltage constant from the start of lamp operation and furthermore to produce an arc discharge between the projections which constitute the desired arc formation positions. Thus, the disadvantage of arc spot deviations from the optical system is eliminated. Since the projections are formed by the shafts of the electrodes, the production process is simplified, and, furthermore, the discharge arc can be positioned at the correct point, i.e., from a starting point which is located on the projection.

One embodiment of the invention is characterized in that the ratio L1/D1 of the value of the maximum outside diameter D1 of the above described part with the decreasing diameter to the distance L1 between the tip of the above described projection and the maximum outside diameter of this part with a decreasing diameter in the axial direction is 0.5 to 1.5, and more preferably the above described ratio L1/D1 is 0.8 to 1.2.

Still another embodiment of the invention is characterized in that the width of the above described part with a decreasing diameter or of the above described part with a larger diameter at a distance of 0.5 mm from the tip of the projection is 0.5 mm to 1.0 mm. In the above described embodiment, the electrode shape is established with specific numerical values.

Still another embodiment of the invention is characterized in that the above described part with a decreasing diameter is formed by melting through irradiation with laser light or electron beams. That is, the above described cannon ball-shaped electrodes can be advantageously formed by irradiation with laser light or electron beams. Specifically, the electrode surface is melted and shaped with high precision by irradiation with laser light from a small diameter light beam.

Still another embodiment of the invention is characterized in that the side of the above described part with the decreasing diameter is provided with a corrugated shape. While, in another embodiment of the invention, the above described part with the larger diameter is provided with a coil-like shape. Further, another embodiment of the invention is characterized by the area in which the part with the decreasing diameter is connected to the part with a larger diameter is formed in fillet-like shape.

The invention is further described below with reference to the accompanying drawings.

BRIEF DESCRIPTION OF THE DRAWINGS

FIGS. 2(*a*) and 2(*b*) each schematically show the arrangement of the electrodes of an ultra-high pressure mercury lamp of the invention;

FIGS. 7(*a*) and (*b*) each schematically show the arrangement of the electrodes of a conventional ultra-high pressure mercury lamp.

DETAILED DESCRIPTION OF THE INVENTION

Figure 1:
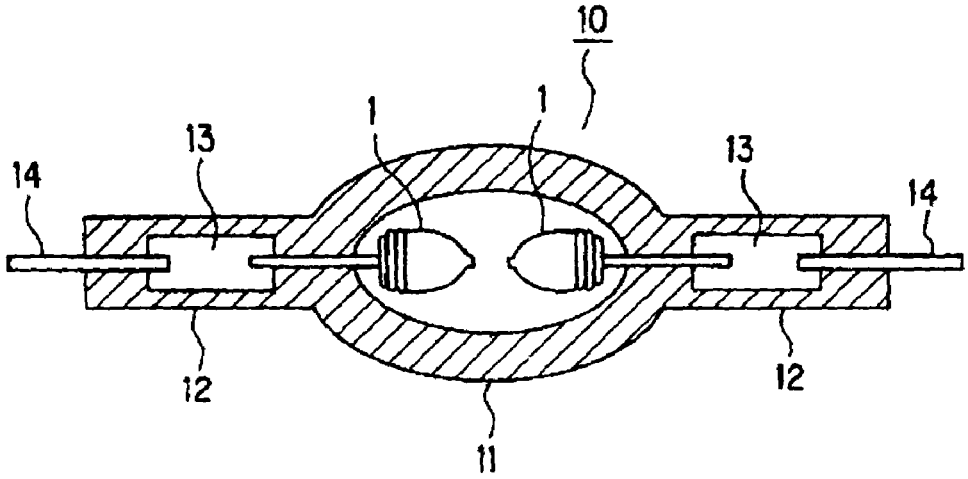
FIG. 1 is a schematic cross-sectional view of a ultra-high pressure mercury lamp of the invention.
Figure 3A:
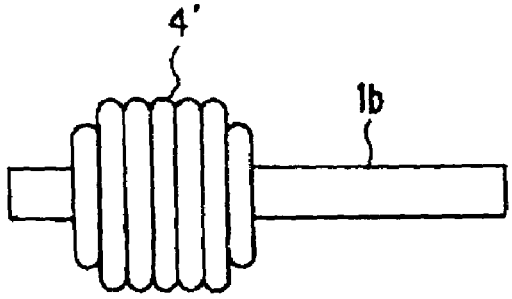
FIGS. 3(*a*) to 3(*d*) each schematically show the arrangement of one electrode of an ultra-high pressure mercury lamp of the invention.
Figure 3B:
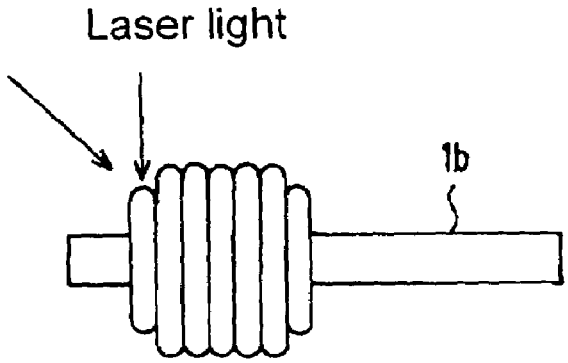
Figure 3C:
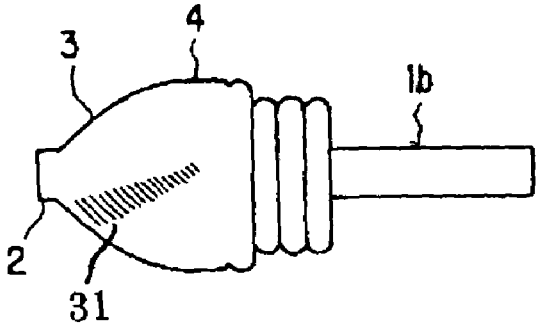
Figure 3D:
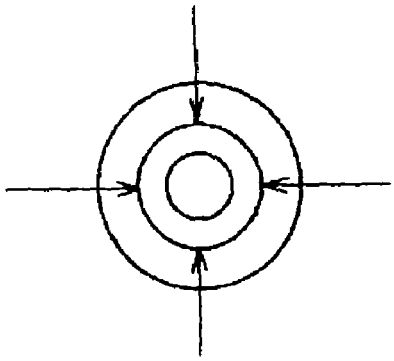
Figure 4A:
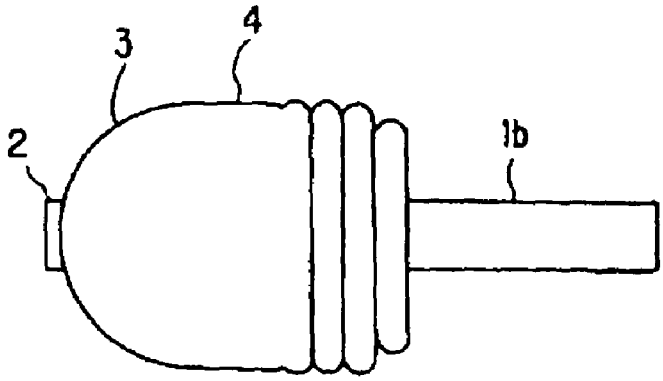
FIGS. 4(*a*) to 4(*d*) each schematically show the arrangement of one electrode of an ultra-high pressure mercury lamp of the invention.
Figure 4B:
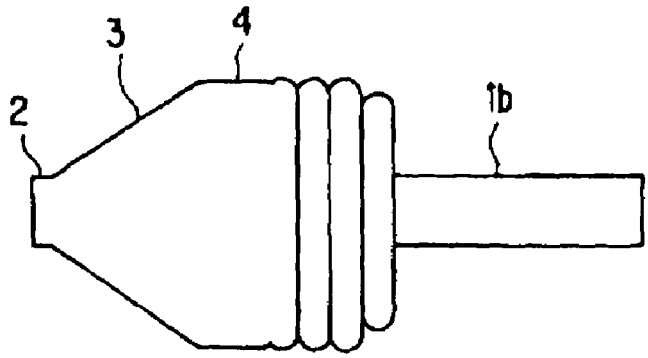
Figure 4C:
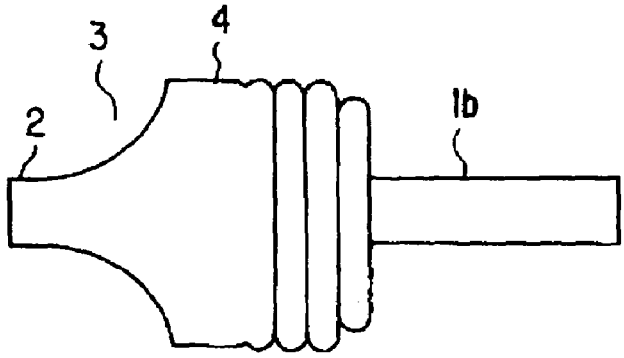
Figure 4D:
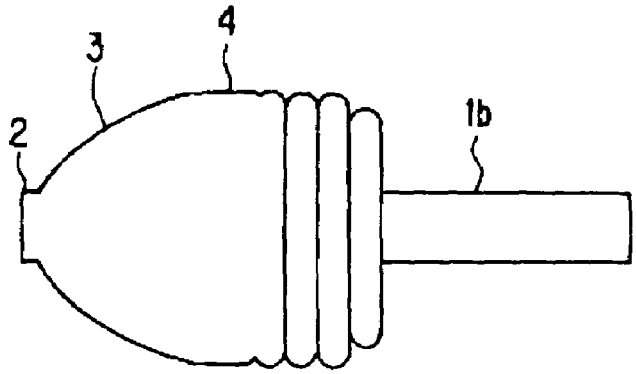

FIG. 1 shows the entire arrangement of the short arc ultra-high pressure mercury lamp of the invention (hereinafter referred to as a "discharge lamp"). In FIG. 1, a discharge lamp 10 has an essentially spherical light emitting part 11 which is formed of a silica glass discharge vessel. In this light emitting part 11, there is a pair of opposed electrodes. From the two ends of the light emitting part 11, there extend hermetically sealed portions 12 in which, for example, a molybdenum conductive metal foil 13 is hermetically installed by a shrink seal. For each electrode 1, the shaft is electrically connected to the metal foil 13 by welding. An outer lead 14 which projects to the outside is welded to the other end of the respective metal foil 13.

The light emitting part 11 is filled with mercury, a rare gas and a halogen gas. The mercury is used to obtain the required wavelength of visible radiation, for example, to obtain radiant light with wavelengths from 360 nm to 780 nm, and is added in an amount of at least 0.15 mg/mm$^3$. The added amount of mercury differs depending on the temperature condition, but during operation, an extremely high vapor pressure, i.e., at least 150 atm, is achieved. By adding a larger amount of mercury, a discharge lamp with a high mercury vapor pressure during operation of at least 200 atm or at least 300 atm can be produced. That is, the higher the mercury vapor pressure, the more suitable the light source for use in a projector device. The rare gas can be argon, at roughly 13 kPa, which enables the starting property to be improved.

The halogens can be iodine, bromine, chlorine and the like in the form of a compound with mercury or another metal. The halogen is added in an amount which ranges from $10^{-6}$ μmol/mm$^3$ to $10^{-2}$ μmol/mm$^3$ which enables a prolonged service life. For an extremely small discharge lamp with a high internal pressure, such as in the discharge lamp of the invention, the main purpose of adding the halogen is to prevent devitrification of the discharge vessel.

Normally, the lamp is operated using an alternating current. While the numerical values of the discharge lamp are shown by way of example below:

- the maximum outside diameter of the light emitting part is 9.5 mm;
- the distance between the electrodes is 1.5 mm;
- the inside volume of the arc tube is 75 mm$^3$;
- the rated voltage is 80 V; and
- the rated wattage is 150 W.

Such a discharge lamp can be located in a small projector device that is as small as possible. Since the overall dimension of the projector device is extremely small and since there is a demand for high light intensity, the thermal influence within the arc tube portion is therefore extremely limited, i.e., the value of the wall load of the lamp is 0.8 W/mm$^2$ to 2.0 W/mm$^2$, specifically 1.5 W/mm$^2$.

The lamp of the invention, which has such a high mercury vapor pressure and a high value of the wall load, leads to the ability of the discharge lamp to produce radiant light with good color rendering when installed in a projector device or a presentation apparatus, such as an overhead projector or the like.

FIGS. 2(*a*) and 2(*b*) each schematically show the electrodes 1 in an enlargement. FIG. 2(*a*) shows a pair of electrodes 1; while FIG. 2(*b*) shows a pair of electrodes in which an arc A which has formed therebetween.

The electrode 1 includes a projection 2, a part with a decreasing diameter 3, a part with a larger diameter 4 and a shaft 1*b*. The spherical part 1*a* in FIGS. 7(*a*) and 7(*b*) corresponds to the part with the decreasing diameter 3 and the part with a larger diameter 4. The projection 2 is formed by the tip of the shaft 1*b* and has a diameter which is approximately equal to the outside diameter of the shaft 1*b* or, as a result of melting, has a diameter that is slightly larger or smaller than the outside diameter of the shaft 1*b*. Accordingly, this means that the projection 2 is not formed and does not grow during the operation of the discharge lamp. That is, the projection 2 is formed on the tip surface of the shaft 1*b* before the discharge lamp is constructed.

For example, for the part of the electrode with the greater diameter 4, filamentary tungsten can be wound in the manner of a coil. The greater diameter part 4 acts as a starting material through the concave-convex effect of the surface when the lamp operation begins (start position). Moreover, greater diameter part 4 makes the breakdown easy through the concave effect of the surface when the lamp is ignited. Since the coil is thin, it is easily heated which simplifies the transition from a glow discharge to an arc discharge. Further, the part with a decreasing diameter 3 is located between the part with a larger diameter 4 and the tip projection 2 and is formed, as is described below, by the melting of the tungsten.

FIGS. 3(*a*) to 3(*d*) schematically show the process for producing the electrode 1. That is, FIG. 3(*a*) shows the state before completion of the electrode. For example, a shaft 1*b*, which can be tungsten or the like, is wound with a filamentary coil 4' in two layers, which can also be tungsten.

The numerical values are shown by way of example below.

The length of the shaft 1*b* is in the range from 5.0 mm to 10.0 mm and is, for example, 7.0 mm; and the outside diameter of the shaft 1*b* is in the range from 0.2 mm to 0.6 mm and is, for example, 0.4 mm.

Furthermore, the position of the filament coil 4' is in the range from 0.4 mm to 0.6 mm from the tip of the shaft 1*b*. The filament coil 4' is wound proceeding from a position which can be 0.5 mm away from the tip of the shaft 1*b*. Additionally, the position of the filament coil 4' is in the range from 1.5 mm to 3.0 mm in the axial direction, e.g., the coil 4' is wound in a length of 1.75 mm.

The wire diameter of the filament coil 4' is in the range from 0.1 mm to 0.3 mm, e.g., 0.25 mm. The two-layer winding of the shaft 1*b* in the above described manner easily forms a tapering shape. This wire diameter and this number of layers of the filament coil 4' can be suitably adjusted according to the particular requirements of the discharge lamp and according to the light beam diameter of the laser light.

FIG. 3(*b*) shows a state in which the coil 4' is irradiated with laser light. The laser light is radiant light, e.g., from a YAG laser, which irradiates the coil 4' at a position which is closest to the tip of the shaft 1*b* and can proceed, if necessary, towards the rear end such that the entirety of the filament coil 4' is irradiated. The uniform irradiation of a given position of the coil 4' with laser light, of a small light beam diameter, results in the coil 4' on the shaft 1*b* being melted in the manner illustrated. In this way, the shape of the electrode can be matched to the specification of the discharge lamp.

The filament coil 4' can be irradiated perpendicularly with laser light, or, as illustrated in FIG. 3(*b*), the filament coil 4' can be irradiated obliquely or both perpendicularly and obliquely.

As is shown in FIG. 3(*d*), it is desirable to sequentially irradiate the filament coil with laser light for all four directions by sequentially heat treating, cooling and solidifying from one direction after the other. It is noted that, with simultaneous heating from all four directions, it is possible for the heat to reach the tip and for the projection to disappear by melting. If, however, this disadvantage does not arise, simultaneous heating, from four directions axis-symmetrically, can also be carried out which will produce a shape with good balance. In order to produce a well-balanced shape, however, the irradiation positions in the axial lengthwise directions of the four directions must be subjected to fine adjustment for each direction, FIG. 3(*d*) is a representation which is viewed from the tip as shown in FIG. 3(*b*). Additionally, it is advantageous to perform the irradiation with laser light in an atmosphere of argon gas or the like in order to prevent oxidation of the electrodes.

Furthermore, it is within the scope of the invention to not limit to irradiation with laser light to only four directions, but that irradiation with laser light from one direction, two directions, three directions, five directions or some other number of directions is possible.

It is preferred that the light beam diameter is roughly equal to the diameter of the electrode axis. The numerical values are shown by way of example below.

The laser light beam diameter is 0.2 mm to 0.7 mm, and for example, 0.6 mm; and the duration of irradiation is 0.2 sec to 1.0 sec, and for example, 0.35 sec.

While the laser irradiation process can be carried out continuously, pulsed irradiation can also be carried out. The term "pulsed radiation" is defined as irradiation in which irradiation occurs with a short duration (millisecond range) and pauses in between before repeating. This irradiation is normally more effective than continuous irradiation.

FIG. 3(*c*) shows the state of the electrode in which the part with a decreasing diameter 3 has been formed by the above described laser light irradiation process. It is noted that the surface of the part 3 with the decreasing diameter and the surface of the part 4 with a greater diameter 4 have been melted and are now smooth. Further, it is not necessary to melt the interior of the parts 3 and 4 of the electrode. That is, the desired shapes can be produced by merely melting of the surfaces.

The numerical values are shown, by way of example, below.

The outside diameter of the projection is 0.15 mm to 0.6 mm and is for example 0.3 mm;

The length in the axial direction of the projection is 0.1 mm to 0.4 mm and is, for example, 0.25 mm;

The diameter of the tip of the part with the decreasing diameter is from 0.15 mm to 0.6 mm and is, for example, 0.3 mm;

The diameter of the rear end of the part with the decreasing diameter is from 1.0 mm to 2.0 mm and is, for example, 1.4 mm;

The length in the axial direction of the part with the decreasing diameter is from 0.7 mm to 1.5 mm and is, for example, 1.0 mm;

The outside diameter of the part with the greater diameter is roughly equal to the maximum outside diameter of the part with a decreasing diameter; and The length in the axial direction of the part with the greater diameter is 0.7 mm to 2.0 mm and is, for example, 1.0 mm.

The electrode arrangement of the discharge lamp of the invention is characterized in that the coil wound on the shaft is irradiated with laser light and that the electrode provided with a projection is shaped by melting. The shape of the electrode can be adjusted by laser irradiation such that a projection having small dimension remains.

A corrugation can be formed in the surface of the part with a decreasing diameter by melting the tungsten filament with laser light irradiation from three to four directions, one direction after the other, such that the decreasing diameter coiled filament is heated and shaped in an interrupted manner followed by cooling and solidification. This is possible due to the thermal effect being limited to an extremely small area in which shaping takes place upon heating for a short duration.

Instead of laser light irradiation, electron beams can also be used for the irradiation. Since an electron beam can have a diameter that is small, the electron beam is also well-suited for melting extremely small areas of tungsten filament in the invention. For example, the electron beam device disclosed in Japanese patent disclosure document 2001-59900 and Japanese patent disclosure document 2001-174596 is especially suited for the practice of the invention due to its small shaped beam.

The production of electrodes using conventional TIG welding, instead of laser light or an electron beam, becomes difficult when the electrode diameter is less than or equal to 1 mm. This is because in TIG welding the entire coil 4' serves as the electrode (anode) during welding, and, therefore, fine melt control for formation of the projection can be achieved only with great difficulty. However, if forming the desired projection and the desired electrode shape of the invention is successful by TIG welding, the invention is not limited only to laser light irradiation and electron beam irradiation, but can include conventional TIG welding as well.

The electrode arrangement of the discharge lamp of the invention is provided with the projection using the shaft of the electrode prior to construction of the discharge lamp. That is, the projection on the electrode arrangement of the discharge lamp of the invention is not produced in the course of operation of the discharge lamp, i.e. by the natural phenomenon described previously, but that it is produced beforehand in the described production process. In this way, the arc discharge between the projections can be produced with certainty from the start of lamp operation and the lamp voltage maintained at an essentially constant value. This eliminates the disadvantage of a major reduction of lamp voltage due to production of the projections during operation and the disadvantage of reduction of the degree of light utilization as a result of the unwanted occurrence of an arc position.

In the previous discharge lamps, an ultra-high pressure mercury lamp is constructed in which the distance between the electrodes is at most 2 mm and in which the light emitting part is filled with at least 0.15 mg/mm$^3$ of mercury, rare gas and halogen in the range from $10^{-6}$ μmole/mm$^3$ to $10^{-2}$ μmole/mm$^3$. Further, since the discharge lamp has the above described arrangement, in the course of lamp operation projections are formed on the electrode tips.

It may be possible that there is a discharge lamp with projections or the like formed inherently beforehand among those discharge lamps which do not have the above described inventive arrangement and which have completely different applications and the like. However, since in such discharge lamps there is no technical problem and object associated with respect to production and growth of projections, it can be stated that any such discharge lamps relate to a completely different field than the invention described above.

The invention of the currently described discharge lamp, used under the conditions in which in the course of lamp operation projections are normally formed and grow, substantially eliminates the formation and growth of the projections during operation of the discharge lamp and thus eliminates the disadvantages associated with this phenomenon.

It is of particular note that the projection growth disclosed in Japanese patent disclosure document 2001-312997 (see the English equivalent—U.S. Pat. 6,545,430) described previously is characterized in that the conditions for projection growth are determined for each lamp, e.g., the properties of the individual discharge lamp, the operating conditions and the like, and the projections form as a natural phenomenon proceeding from the zero state prior to use of the discharge lamp. On the other hand, in the discharge lamp of the invention, based on the operating specification conditions determined beforehand and the properties of the discharge lamp (distance between the electrodes, the amount of gas added and the like), the size of the projection can be estimated and artificially produced using the tip of the shaft as discussed above. In this respect, the two technical approaches differ considerably from one another.

The various shapes of the electrodes of the invention are described with reference to FIGS. 4(*a*) to 4(*d*).

FIG. 4(*a*) illustrates the embodiment in which the part with the decreasing diameter in the direction toward the projection of the tip is hemispherical while FIG. 4(*b*) illustrates the embodiment of a tapering shape in which the part with the decreasing diameter in the direction toward the projection at the tip reduces its diameter in a straight line, i.e., is conic. FIG. 4(*c*) illustrates the embodiment of a concave curve-like shape in which the part with the decreasing diameter in the direction toward the projection on the tip has fallen more to the inside than the taper while FIG. 4(*d*) illustrates the embodiment of a shape in which the part with a decreasing diameter in the direction toward the projection on the tip convexly reduces its diameter in a bullet tip shape.

When the part with the decreasing diameter decreases its diameter from the part with the larger diameter in the direction toward the projection during melt formation process described above, the shapes are not limited to those described above, but other variation can also be constructed. For each variation, however, the projection is formed at the tip area of the electrode shaft. These shapes can be produced with high precision by the above described laser light irradiation process.

Figure 5A:
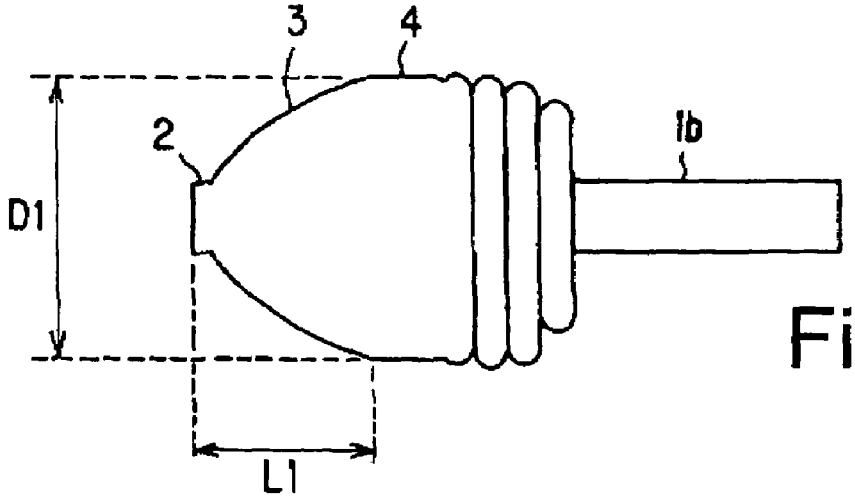
FIGS. 5(*a*) to 5(*c*) each schematically show the arrangement of one electrode of an ultra-high pressure mercury lamp of the invention.
Figure 5B:
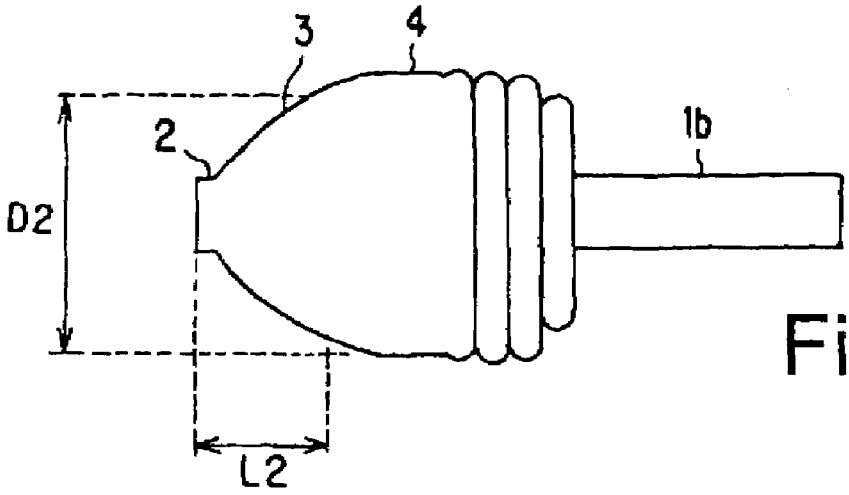
Figure 5C:
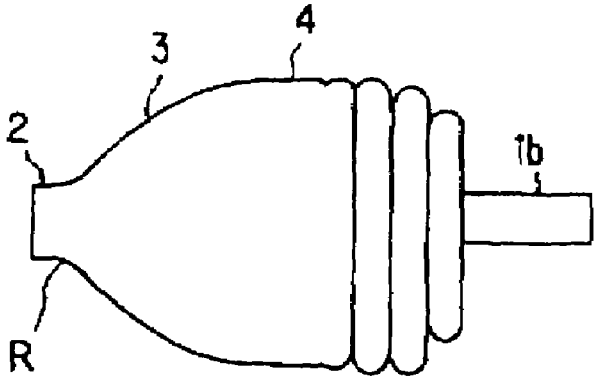

FIGS. 5(*a*) to 5(*c*) each schematically show the bullet tip-shaped electrode shown in FIG. 4(*d*). In FIGS. 5(*a*) and 5(*b*), the value of the maximum outside diameter D1 of the part with the decreasing diameter and the distance L1 from the tip of the projection is fixed. In FIG. 5(*a*), the ratio L1/D1 of the value of the maximum outside diameter D1 of the part with the decreasing diameter to the distance L1 between the tip of the projection and the maximum outside diameter of this part with a decreasing diameter in the axial direction is 0.5 to 1.5, and preferably 0.8 to 1.2.

In FIG. 5(*b*), the value of the outside diameter D2 of the part with a decreasing diameter or of the part with an increasing diameter at a distance of 0.5 from the tip of the projection in the axial direction is 0.5 to 1.0. In FIG. 5(*c*), on the boundary between the projection and the part with a decreasing diameter a part R is formed and a fillet form is obtained. This structural feature is formed from the production process in which the projection is produced in such a way that the shaft is taken as a reference and in which the part with a decreasing diameter is formed by melting of the coil 4'. The "boundary between the projection and the part with a decreasing diameter" means the area in which the two adjoin one another and which is formed when the part with the greater diameter is melted and is formed in one part with the shaft.

By fixing the numerical values in this way, the surface of the part with the decreasing diameter assumes a shape which is vigorously subjected to the radiant heat from the arc discharge. Specifically, the tip surface of the electrode is massively subjected to radiant heat from the arc by which melt vaporization forms on the tip surface of the electrode. This melt vaporization of the electrode material not only makes the shape of the electrode unstable, but causes the disadvantage of contamination of the inside of the arc tube by the vaporized material and similar disadvantages. Furthermore, by vaporizing the tungsten as the electrode material the amount of tungsten which floats within the light emitting part is increased, by which the growth of the projection can be intensified. In the current invention, the overall shape can be made cannon ball-shaped by the above described fixing of the numerical values, especially by the measure that L1/D1 is fixed at 0.8 to 1.2. In this way, the absorbed amount of radiant heat from the arc can be reduced and the melt vaporization of the electrode surface can be prevented.

As was described above, this fine formation of the electrode shape of the invention is made possible by the melt shaping with laser light irradiation.

The numerical values of the discharge lamp are shown by way of example below.

The outside diameter of the light emitting part is in the range of 8 mm to 12 mm and is, for example, 10.0 mm;

the inside volume of the light emitting part is in the range of 50 $mm^3$ to 120 $mm^3$ and is, for example, 65 $mm^3$; and the distance between the electrodes is in the range from 0.7 mm to 2 mm and is, for example, 1.0 mm.

The discharge lamp is operated with a rated wattage of 200 W and a rectangular waveform of 150 Hz.

Figure 6:
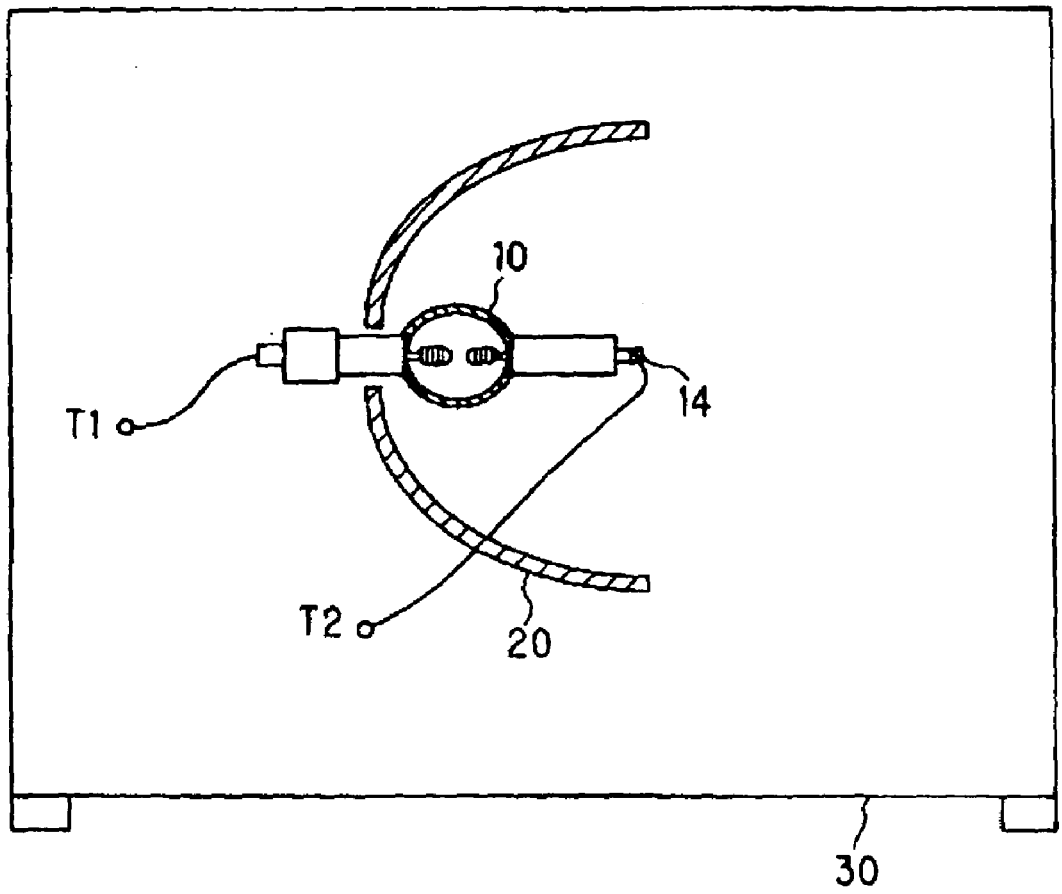
FIG. 6 is a schematic cross-sectional view of a light source device using the ultra-high pressure mercury lamp of the invention.

FIG. 6 illustrates the discharge lamp 10, a concave reflector 20 which surrounds this discharge lamp 10 (hereinafter called a "light source device") installed in a projector device 30. In the projector device 30, the optical parts which are complex and the electrical parts are tightly arranged. Therefore, it is shown simplified in FIG. 6 to facilitate the description.

The discharge lamp 10 is held through an upper opening of the concave reflector 20. A feed device (not shown) is attached to the terminals T1 and T2 of the discharge lamp 10. For a concave reflector 20, an oval reflector or a parabolic reflector is used. The reflection surface is provided with a film which has been formed by vacuum evaporation and which reflects light with given wavelengths. The focal position of the concave reflector 20 lies in the arc position of the discharge lamp 10. The light of the arc spot can emerge with high efficiency from the reflector. Furthermore, the concave reflector 20 can also be provided with a translucent glass which closes the front opening.

While it is desirable for the above described electrode arrangement to be used for the both electrodes of the discharge lamp, the above described electrode arrangement can also be used only for one of the electrodes. Further, while an ultra-high pressure mercury lamp of the AC operating type was described above, the above described electrode arrangement can also be used for an ultra-high pressure mercury lamp of the DC operating type.

As was described above, the electrode arrangement of the discharge lamp of the invention is characterized by a projection that is formed at the tip of the shaft prior to the production of the discharge lamp. Therefore, an arc discharge can be reliably produced at the projections from the start of lamp operation, and the lamp voltage can be maintained at an essentially constant value. Furthermore, the arc can also be formed at a given point and when employed in conjunction with the optical system the degree of light utilization can be increased.

What is claimed is:

1. A short arc ultra-high pressure mercury lamp comprising:

a silica glass arc tube filled with at least 0.15 $mg/mm^3$ of mercury, rare gas and halogen in a range from $10^{-6}$ $\mu mole/mm^3$ to $10^{-2}$ $\mu mole/mm^3$;

a pair of opposed electrodes each being held by a shaft within the silica glass arc tube at a spaced apart distance of at most 2 mm, wherein at least one of the opposed electrodes includes a part with a greater diameter formed on the shaft using a melting process, a projection formed by the tip of the shaft, and a part with a decreasing diameter which extends from the part with the greater diameter in the direction toward the projection and is also formed using a melting process.

2. The short arc ultra-high pressure mercury lamp set forth in claim 1, wherein the ratio L1/D1 is 0.5 to 1.5, where D1 is the value of the maximum outside diameter of the part with the decreasing diameter at a distance L1 which is a distance in the axial direction from a tip of the projection to the maximum outside diameter of the part with a decreasing diameter.

3. The short arc ultra-high pressure mercury lamp set forth in claim 2, wherein the ratio L1/D1 is 0.8 to 1.2.

4. The short arc ultra-high pressure mercury lamp set forth in claim 1, wherein width of the part with a larger diameter is 0.5 mm to 1.0 mm in an area at a distance of 0.5 mm from the tip of the projection.

5. The short arc ultra-high pressure mercury lamp set forth in claim 1, wherein the width of the part with a decreasing diameter is 0.5 mm to 1.0 mm in an area at a distance of 0.5 mm from the tip of the projection.

6. The short arc ultra-high pressure mercury lamp set forth in claim 1, wherein the part with the decreasing diameter is formed using irradiation with laser light or electron beams so as to perform heating-melting wherein the irradiation is interrupted by pauses to form a corrugated shape on the part with the decreasing diameter.

7. The short arc ultra-high pressure mercury lamp set forth in claim 1, wherein the outside surface of the part with the decreasing diameter has a corrugation.

8. The short arc ultra-high pressure mercury lamp set forth in claim 1, wherein the part with the greater diameter is coil-shaped.

9. The short arc ultra-high pressure mercury lamp set forth in claim 1, wherein the area in which the part with the decreasing diameter is connected to the part with a larger diameter has a fillet-shape.

10. The short arc ultra-high pressure mercury lamp set forth in claim 1, wherein the area in which the part with the decreasing diameter borders the projection has a fillet-shape.

11. The short arc ultra-high pressure mercury lamp set forth in claim 10, wherein the fillet-shape is formed by melting the part with the decreasing diameter to the projection.

12. The short arc ultra-high pressure mercury lamp set forth in claim 9, wherein the fillet-like shape is formed by melting from the part with the decreasing diameter to the part with the greater diameter.

13. A short arc ultra-high pressure mercury lamp comprising:

a silica glass arc tube filled with at least 0.15 mg/mm$^3$ mercury, rare gas and halogen in the range from $10^{-6}$ μmole/mm$^3$ to $10^{-2}$ μmole/mm$^3$;

a pair of opposed electrodes, each being held by a shaft spaced apart at a distance of at most 2 mm, wherein at least one opposed electrode is manufactured by winding the shaft with a metal filament to form a coil such that an unwound projection remains exposed on the tip of the shaft, and the filament is wound repeatedly around the shaft to form a part of the coil with a diameter which decreases in the direction toward the projection and a part of coil with a larger diameter after the part of the coil with the decreasing diameter in a direction away from the projection, and at least the surface of the part of the coil with the decreasing diameter and the surface of the part of the coil with the greater diameter are melted.

14. The short arc ultra-high pressure mercury lamp set forth in claim 13, wherein the exposed surfaces of the coiled filaments are melted to form a uniformly smooth surface with a wave-like surface profile.

15. The short arc ultra-high pressure mercury lamp set forth in claim 13, wherein a surface portion of the filament coil following the part with the greater diameter in a direction away from the projection is not melted.

16. The short arc ultra-high pressure mercury lamp set forth in claim 13, wherein the metal filament adjacent to the projection is melted to the shaft.

17. The short arc ultra-high pressure mercury lamp set forth in claim 13, wherein the metal filament is composed of tungsten.

18. The short arc ultra-high pressure mercury lamp set forth in claim 13, wherein the melting of the metal filament is performed by irradiation by at least one of an electron beam generating means and a laser light beam generation means.

19. The short arc ultra-high pressure mercury lamp set forth in claim 17, wherein the melting process is performed in several steps each of which are interrupted by pauses in the irradiation.

20. The short arc ultra-high pressure mercury lamp set forth in claim 13, wherein the ratio L1/D1 is 0.5 to 1.5, where D1 is the value of the maximum outside diameter of the part with the decreasing diameter at the distance L1 which is the distance in the axial direction from tip of the projection to the maximum outside diameter of the part with a decreasing diameter.

21. The short arc ultra-high pressure mercury lamp set forth in claim 13, wherein the ratio L1/D1 is 0.8 to 1.2.

22. The short arc ultra-high pressure mercury lamp set forth in claim 13, wherein the width of the part with a larger diameter is 0.5 mm to 1.0 mm in the area at a distance of 0.5 mm from the tip of the projection.

23. The short arc ultra-high pressure mercury lamp set forth in claim 13, wherein the width of the part with a decreasing diameter is 0.5 mm to 1.0 mm in the area at a distance of 0.5 mm from the tip of the projection.

* * * * *